US005287588A

United States Patent [19]

Gurstein et al.

[11] Patent Number: 5,287,588

[45] Date of Patent: Feb. 22, 1994

[54] UPHOLSTERY AND CARPET CLEANING EQUIPMENT INCLUDING EXTERNAL HEAT EXCHANGER

[75] Inventors: Bernard Gurstein; Russell Gurstein, both of Hayden Lake, Id.

[73] Assignee: U.S. Products, Inc., Hayden Lake, Id.

[21] Appl. No.: 836,471

[22] Filed: Feb. 18, 1992

Related U.S. Application Data

[63] Continuation-in-part of Ser. No. 304,254, Jan. 31, 1989, Pat. No. D. 326,545.

[51] Int. Cl.[5] ..... A47L 11/03

[52] U.S. Cl. ..... 15/321; 15/339; 219/630; 392/444

[58] Field of Search ..... 15/321; 219/10.51; 392/444, 479, 480, 481

[56] References Cited

U.S. PATENT DOCUMENTS

| | | | |
|---|---|---|---|
| D. 241,266 | 8/1976 | Dillon | D32/28 |
| D. 311,723 | 10/1990 | Eggleston et al. | D13/184 X |
| 1,563,296 | 11/1925 | Scarborough | 219/10.51 |
| 1,670,032 | 5/1928 | Gibbons | 392/481 |
| 1,724,767 | 8/1929 | Mercer | 392/481 |
| 2,347,122 | 4/1944 | Peet | 392/481 |
| 2,472,713 | 6/1949 | Lijoi | 392/481 |
| 2,481,813 | 9/1949 | Bede | 392/481 |
| 2,585,132 | 2/1952 | Kalmadge | 392/396 X |
| 3,188,503 | 6/1965 | Hendry | 307/141 |
| 4,308,636 | 1/1982 | Davis | 15/321 |
| 4,724,824 | 2/1988 | McCoy et al. | 392/396 |
| 4,764,660 | 8/1988 | Swintosz | 392/397 |

*Primary Examiner*—Chris K. Moore
*Attorney, Agent, or Firm*—Sheridan Neimark

[57] ABSTRACT

An independent unit heat exchanger is provided downstream of a machine for cleaning upholstery and/or carpets so that unheated detergent water from the cleaning machine passes through a hose and then through the heat exchanger where it is heated to an elevated temperature, and then to the cleaning nozzle where it is discharged. The heat exchanger is provided with an electric heating core about which pipe carrying the detergent water is coiled.

3 Claims, 1 Drawing Sheet

UPHOLSTERY AND CARPET CLEANING EQUIPMENT INCLUDING EXTERNAL HEAT EXCHANGER

This is a CIP now U.S. Pat. No. 326,545, issued May 26, 1992 of co-pending parent application Ser. No. 07/304,254, filed Jan. 31, 1989 design for External Heat Exchanger for Upholstery and Carpet Cleaning Equipment, the contents of which are hereby incorporated by reference.

FIELD OF THE INVENTION

The present invention relates to upholstery and carpet cleaning equipment, and more particularly to an external heat exchanger for such equipment.

BACKGROUND

Carpet and upholstery cleaning equipment has been known and used for many years. Prior to the introduction into the marketplace of a device in accordance with the present invention, the cleaning liquid, i.e. detergent or soap containing water, was merely introduced into a vat or holding tank of the machinery in question, and the cleaning liquid was heated by the use of a simple immersion heater. This type of system, however, provided many problems, some of these being briefly outlined below.

Thus, there is some danger in the use of immersion heaters, e.g. workers can be burned if immersion heaters are not properly handled. In addition, because the cleaning liquid comes in direct contact with exposed heater coils in an open vat, such immersion heaters can only be used when the cleaning liquid is water, i.e. they cannot be used with dry cleaning fluid. Moreover, such immersion heaters work very slowly, requiring approximately 20 minutes to heat 10 gallons of water to about 150° F., or 30–40 minutes to heat 20 gallons of water to the same temperature; this slow operation is required to be repeated each time the cleaning tank is re-filled with water.

SUMMARY OF THE INVENTION

It is, accordingly, an object of the present invention to overcome deficiencies in the prior art, such as those indicated above.

It is another object of the present invention to provide a separate unit heat exchanger for use in-line in conjunction with carpet and upholstery cleaning equipment.

It is a further object of the present invention to provide such equipment adapted for connection to carpet and upholstery cleaning machines downstream therefrom so that heated cleaning liquid need not pass through the machine components themselves.

It is still a further object of the present invention to provide such a system where heating of the cleaning liquid is effected inside of a sealed container, thereby protecting the workers who use the equipment.

It is yet another object of the present invention to provide a system for heating cleaning liquid for carpet and upholstery cleaning machines which is substantially increased in its heating efficiency, thereby providing for better and more efficient usage of such machines.

These and other objects of the present invention are achieved according to the present invention by providing an external heat exchanger for heating water that produces 212° F. heat in 2 minutes for use in conjunction with upholstery cleaning equipment or carpet extraction machinery. It quickly connects with the cleaning equipment downstream of the machine so as to insure that no hot water damage will occur to the machine including the pump or lines. It contains a series of coils wrapped around an electric heating core, the water being pumped through the coils where it is heated by the heating core.

BRIEF DESCRIPTION OF THE DRAWING

The invention will be better understood, along with other objects and the nature and advantages of the present invention, from a consideration of a specific embodiment, taken in conjunction with the drawing, wherein.

DETAILED DESCRIPTION OF EMBODIMENT

Figure 1:
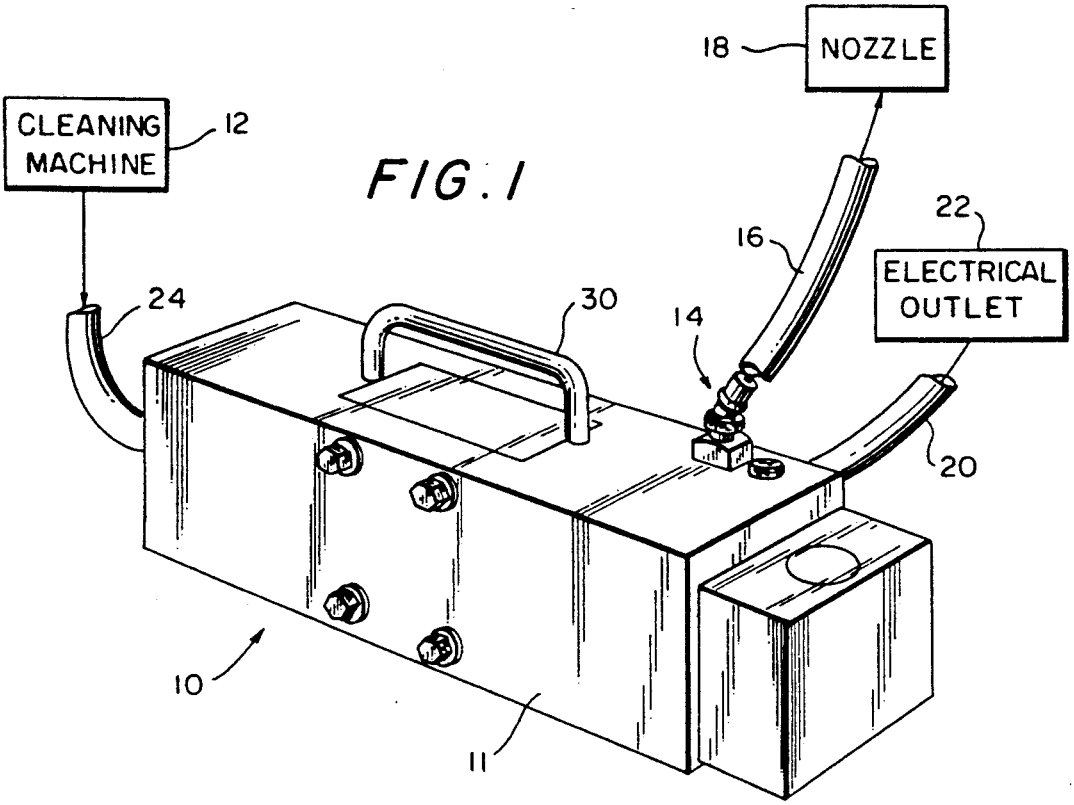
FIG. 1 is a perspective view, partly schematic, of a device according to the present invention.
Figure 2:
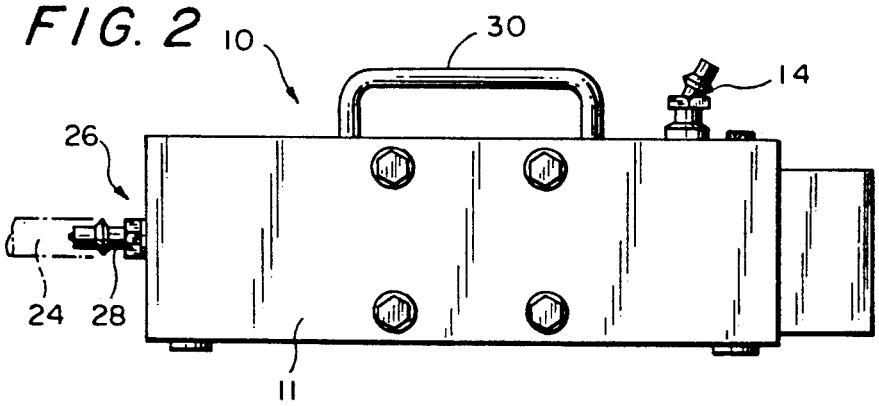
FIG. 2 is a front elevational view of the heat exchanger of the present system.
Figure 3:
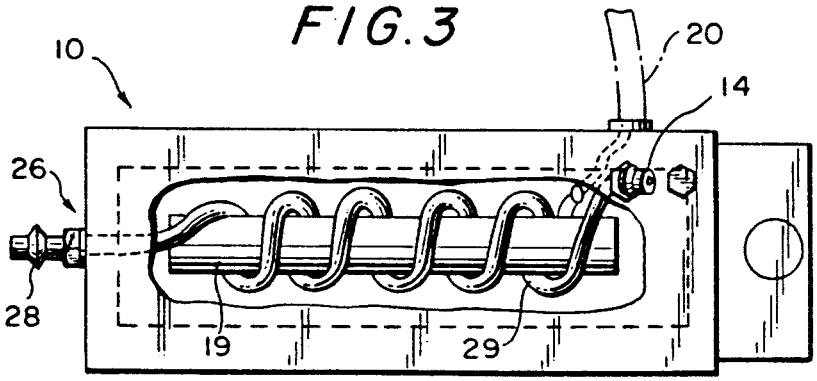
FIG. 3 is top plan view of the heat exchanger of FIGS. 1 and 2, partly broken away to schematically show the interior thereof.

FIG. 1 shows the overall system including a heat exchanger 10 which connects downstream of a carpet or upholstery cleaning machine 12, and has a hot water outlet equipped with an easy-connect/easy-release nipple 14 for connection to a hot cleaning liquid discharge pipe 16 which ends in a cleaning nozzle 18. The heat exchanger 10 is provided with a closed outer housing 11 and, as shown in FIG. 3, internally with an electric heating core 19 which is powered through a suitable electric cable 20 adapted to be plugged into a suitable electric outlet 22.

The heat exchanger 10 is connected downstream of the cleaning machine 12, i.e. it is connected to the cleaning machine through a flexible pipe or hose 24 which feeds cold cleaning liquid from the cleaning machine 12 into the upstream end 26 of the heat exchanger 10 through a suitable, preferably easy-connect and easy-release nipple 28. Within the outer closed shell or housing 11 of the heat exchanger 10 is a pipe 29 which coils about the electric core 19 and passes to the outlet nipple 14. The device is provided with a handle 30 for easy carrying. The nipples 14 and 28 permit easy connection and removal of the hoses 16 and 24, respectively.

The present device provides substantial improvements over the prior art use of immersion heaters. The cleaning liquid never comes in a direct contact with an heating element and is always maintained within the coil 29 while it is being heated, and so it is possible (even if not preferred) to safely use the present device in conjunction with dry cleaning fluid as well as a water based cleaning liquid. The heating element 19 is safely maintained inside of the housing 11 so that the workers are protected, such as by encasing the heating element and coil in an aluminum casting and placing same inside the housing. The heating efficiency is increased by several hundred percent as it is possible to heat water in 2 minutes to 200° F. or more. Time is saved because there is no long wait the for the water to be heated. The cleaning machine is protected because the water is heated downstream from the cleaning machine pump, so that hot liquid never passes through the cleaning machine itself.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a machine for cleaning upholstery or carpets and comprising means for discharging a hot cleaning liquid to the upholstery or carpet to be cleaned including a pump, the improvement comprising:

a heat exchanger in a closed housing separate from said discharging means, said heat exchanger having an electric heating core and a coiled pipe in heat exchange relationship with said electric heating core, said coil having an inlet upstream end and an outlet downstream end each passing through said closed housing, means for connecting a hose from said cleaning machine to said inlet upstream end, and means for connecting a cleaning liquid delivery hose to said downstream outlet tend, and an electric cord for passing electrical energy from an electric outlet to said electrical heating core.

2. A machine according to claim 1 further comprising a carrying handle projecting from said housing.

3. A machine in accordance with claim 1 wherein said means for connecting a hose from said cleaning machine to said inlet upstream end, and said means for connecting a cleaning liquid delivery hose to said downstream outlet end, each comprises a nipple connection.

* * * * *